US005980302A

United States Patent [19]

Saka

[11] Patent Number: 5,980,302

[45] Date of Patent: Nov. 9, 1999

[54] ELECTRICAL CONNECTION BOX FOR A VEHICLE

[75] Inventor: Yuuji Saka, Yokkaichi, Japan

[73] Assignee: Sumitomo Wiring Systems, Ltd., Mie, Japan

[21] Appl. No.: 09/038,052

[22] Filed: Mar. 11, 1998

[30] Foreign Application Priority Data

Mar. 13, 1997 [JP] Japan ..... 9-058752

[51] Int. Cl.[6] ..... H01R 4/24

[52] U.S. Cl. ..... 439/404; 439/949; 439/76.2

[58] Field of Search ..... 439/76.2, 621, 439/695, 949, 404; 174/50.52

[56] References Cited

U.S. PATENT DOCUMENTS

| | | | |
|---|---|---|---|
| 5,229,922 | 7/1993 | Muramatsu | 361/395 |
| 5,618,186 | 4/1997 | Saka et al. | 439/76.2 |
| 5,622,507 | 4/1997 | Kasai | 439/76.2 |
| 5,785,532 | 7/1998 | Maue et al. | 439/34 |
| 5,822,189 | 10/1998 | Isshiki | 361/736 |
| 5,823,798 | 10/1998 | Zintler | 439/76.2 |

FOREIGN PATENT DOCUMENTS

| | | | |
|---|---|---|---|
| 9-23539 | 1/1997 | Japan | H01R 4/24 |
| 9-266018 | 10/1997 | Japan . | |

*Primary Examiner*—Steven L. Stephan
*Assistant Examiner*—Chandrika Prasad
*Attorney, Agent, or Firm*—Oliff & Berridge, PLC

[57] ABSTRACT

An electrical connection box particularly for a vehicle includes an electrically insulating plate dividing the interior space of the casing into first and second space regions, and bus bars and insulation layers arranged alternatingly in a stack in the first space region. The bus bars form first internal electrical circuits of the box. Wires are accommodated in the second space region, and electrical terminal members each having a tab portion connected by pressure grip connections to the wires. The wires and terminal members form second internal electrical circuits. In order to make a compact box and reduce the number of contact points, the stack of bus bars is supported by the plate. The electrical terminal members comprise first members whose tab portions project out through the casing on one side of the plate, and second terminal members whose tab portions project through the casing on an opposite side of the plate. The tab portions of the terminal members are thereby available for connection to terminals of external circuits outside the casing.

9 Claims, 3 Drawing Sheets

ELECTRICAL CONNECTION BOX FOR A VEHICLE

BACKGROUND OF THE INVENTION

1. Field of Invention

The present invention relates to an electrical connection box, particularly an electrical connection box that is mounted in an engine room or other space of a vehicle, such as an automobile. Especially, the present invention relates to an electrical connection box capable of accommodating electrical circuits at high density, which circuits are to be connected to a large number of external circuits, such as relays and fuses, enabling efficient branch connection of wire harnesses. More particularly, the present invention relates to an electrical connection box accommodating internal circuits composed of electric wires and terminals connected therewith by pressure grip connections and internal circuits composed of bus bars.

2. Description of Related Art

In a conventional vehicle electrical connection box of this kind having internal circuits composed of electrical wires and terminals connected therewith by pressure gripping and internal circuits composed of bus bars formed by punching electrically conductive metal plates, a power source input circuit for receiving electric power from an alternator is composed of the bus bars, and other circuits are composed of single-core electric wires and the terminals connected therewith.

Functional parts such as relays, fuses, connectors, and the like are mounted on upper and lower surfaces of a casing of the box. Tabs (terminals for connecting internal circuits and external circuits with each other) project from the upper and lower surfaces of the casing to enable connection of the tabs with the functional parts.

JP-A-9-23539, published Jan. 21, 1997, shows one electrical connection box of this type. Inside the casing are a stack of bus bars and insulating layers, and a plate that lies on the stack. The plate has, on its side away from the stack, upstanding walls that provide grooves in which electrical wires lie. Terminal members make pressure grip connections with the wires in the grooves and have tab portions that project through the plate to make connection with the bus bars. Tabs of the bus bars project through the casing to make connection with exterior circuits, e.g. fuse boxes and relay boxes.

While this prior art construction enables an easy solution of the arrangement of the electrical wires and the terminal members connected to them, there are conflicting requirements for the efficient construction and operation of such connection boxes that are not fully meet.

The accommodation of many electrical wires in the box increases the volume, particularly the thickness of the box. Using electric wires and the terminals is advantageous because circuit alterations can be accomplished easily at a low cost, but disadvantageous because each such circuit has two electrical contact portions in its connection path, one of which is formed between a terminal and a wire and the other of which is formed between the terminal and another element. It is preferable to form a circuit of a bus bar because in this case the circuit is allowed to have only one contact portion in its connection path between an external terminal and a tab projecting from the bus bar. A circuit having only one contact portion is in general preferable to a circuit having two contact portions in respect of the reliability to its electrical contact performance.

However, a stack of bus bars and insulation layers interposed between them also increases the thickness of the electrical connection box.

The number of internal wire circuits of the electrical connection box has tended to increase because the number of electric components on or in a vehicle body has been increasing. The increase of the number of circuits has lead to the use of a large electrical connection box. Consequently, it has become difficult to find space for the electrical connection box when mounting it in the engine room or the like of the vehicle body.

SUMMARY OF THE INVENTION

The present invention has been made in view of the above-described problems. Accordingly, it is an object of the present invention to provide an electrical connection box that can be relatively compact and have an improved internal construction, in order to accommodate a large number of internal circuits formed of bus bars in addition to those formed of electrical wires and terminals.

According to the invention, there is provided an electrical connection box having a casing providing an interior space, and an electrically insulating plate located in the interior space and dividing the space into a first space region and a second space region. At least two bus bars and at least one insulation layer are arranged alternatingly in a stack in the first space region, and the stack is carried by the electrically insulating plate. The bus bars constitute a plurality of first internal electrical circuits of the electrical connection box. A plurality of electrical wires are accommodated in the second space region and carried by the electrically insulating plate, and a plurality of electrical terminal members are connected by pressure grip connections to the electrical wires, each electrical terminal member having a tab portion. The electrical wires and the electrical terminal members constitute a plurality of second internal electrical circuits of the electrical connection box. The electrical terminal members are assembled on the electrically insulating plate by insertion in directions transverse to the electrically insulating plate. The electrical terminal members comprise a plurality of first terminal members whose tab portions project out of the second space region and through the casing on one side of the plate, and a plurality of second terminal members whose tab portions project out of the second space region and through the casing on the opposite side of the plate. The tab portions of the first and second terminal members are thereby available for connection to terminals of external circuits outside the casing.

The construction of the invention allows the number of circuits to be increased without increasing the thickness and area of the electrical connection box. It also reduces the number of contact portions in internal circuits, which include the electrical wires. It further allows appropriate selection of the type of internal circuit (bus bar or wire) in accordance with the requirements of the external circuit. The number of bus bars and electrical wires can be selected according to requirements and can be efficiently accommodated in the casing, effectively using the space in the box.

Preferably, the electrically insulating plate has a substantially planar sheet portion dividing the first space region from the second space region, and the insertion directions of the electrical terminal members are perpendicular to the plane of the sheet portion. Preferably, the plate has a plurality of guide members on each side of the sheet portion, each guide member extending away from the sheet portion and providing a recess receiving one of the electrical terminal members.

Typically in the first space region, the bus bars and the insulation layers in the stack have planar portions lying substantially parallel to the plane of the sheet portion of the plate and lying not further from the sheet portion than the outer ends of the guide members on that side.

Preferably each of the bus bars has, formed in one-piece with its planar portion, at least one tab portion extending perpendicularly to the planar portion is out of the first space region and through the casing, so as to be available for connection to a terminal of an external circuit outside the casing. Preferably, in the second space region, the electrical wires lie not further from the sheet portion of the plate than the outer ends of the guide members on that side. Preferably, the electrically insulating plate has a plurality of projections in the second space region separated by gaps in which the electrical wires lie, so that the projections retain the electrical wires in position.

The invention may include a vehicle having an electrical connection box of the invention as described above, with a plurality of external electrical circuits connected to the internal electrical circuits of the electrical connection box, at least one of the external electrical circuits being connected to the tab portions of the electrical terminal members.

When the tab of each of the bus bars is directly electrically connected with the terminal of the external circuit, each circuit has one electric contact portion in its electric connection path, thus having a higher reliability in its electric contact performance than the conventional electrical connection box in which a terminal is connected with electric wires and the terminal of the external circuit. To enhance the safety of a vehicle, it is preferable that circuits of safety devices, such as the power source input circuit, the ignition switch circuit, the air bag circuit, and the door locking circuit are directly connected to the bus bars in this manner.

BRIEF DESCRIPTION OF THE DRAWINGS

One embodiment of the present invention will now be described by way of non-limiting example with reference to the accompanying drawings in which like parts are designated by the same reference numerals, and in which.

DETAILED DESCRIPTION OF PREFERRED EMBODIMENTS

Figure 1:
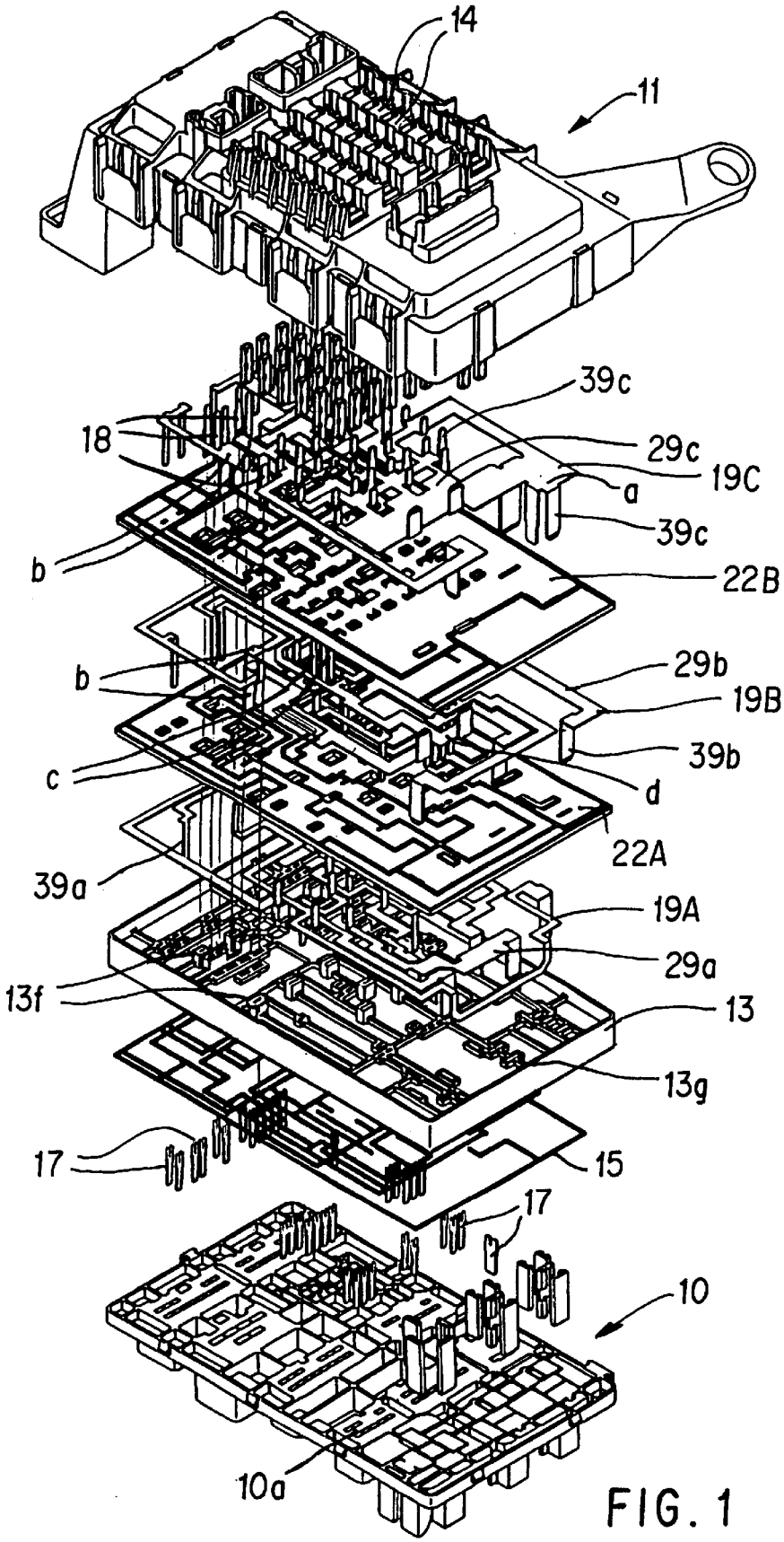
FIG. 1 is an exploded perspective view showing an electrical connection box according to an embodiment of the present invention.
Figure 2:
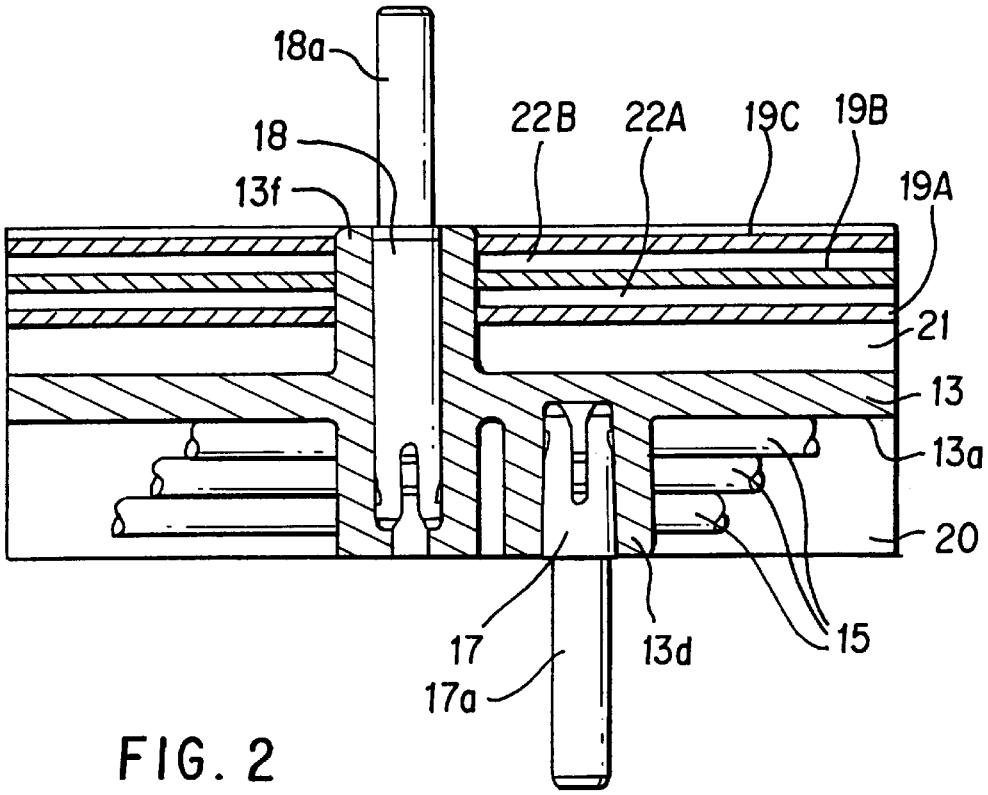
FIG. 2 is an enlarged sectional view showing a portion of the electrical connection box of FIG. 1.

Referring to FIG. 1, an electrical connection box for a vehicle embodying the invention has a casing comprising a lower case part 10 and an upper case part 11. As seen also in FIG. 2, a plate 13 made, for example, of electrically insulating material is installed inside the casing parts 10,11 to form an upper space and a lower space inside the casing such that the volumes of the upper and lower spaces are almost equal. The lower space sandwiched between the plate 13 and the lower case 10 is denoted as an electrical wire accommodating space 20, while the upper space sandwiched between the plate 13 and the upper case 11 is denoted as a bus bar accommodating space 21. FIG. 2 shows only a portion of the plate 13 in cross-section, and omits the case parts 10,11.

Figure 3:
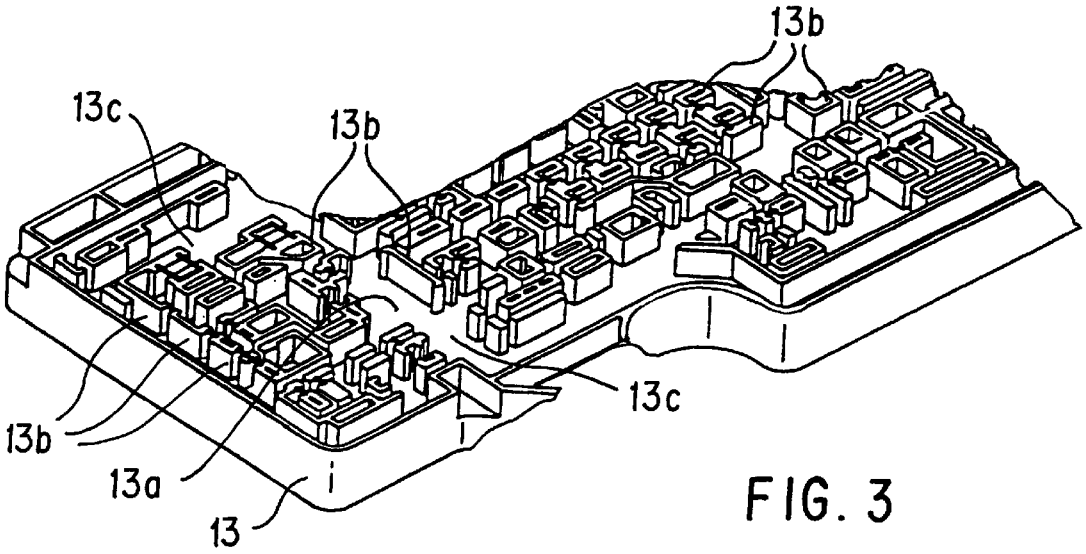
FIG. 3 is a perspective view showing a portion of the lower surface of an electrical insulation plate of the embodiment of FIG. 1.

As shown in FIG. 3, in which a portion of the plate 13 is seen inverted, regions 13*c* of the flat planar surface 13*a* of the plate are surrounded by many projections 13*b* which act to locate and guide the wires on the plate 13. A plurality of single-core electrical wires 15 seen in FIG. 2 pass in layers through the regions 13*c* and provide electrical circuits composed of the wires 15 in the space 20.

Figure 4:
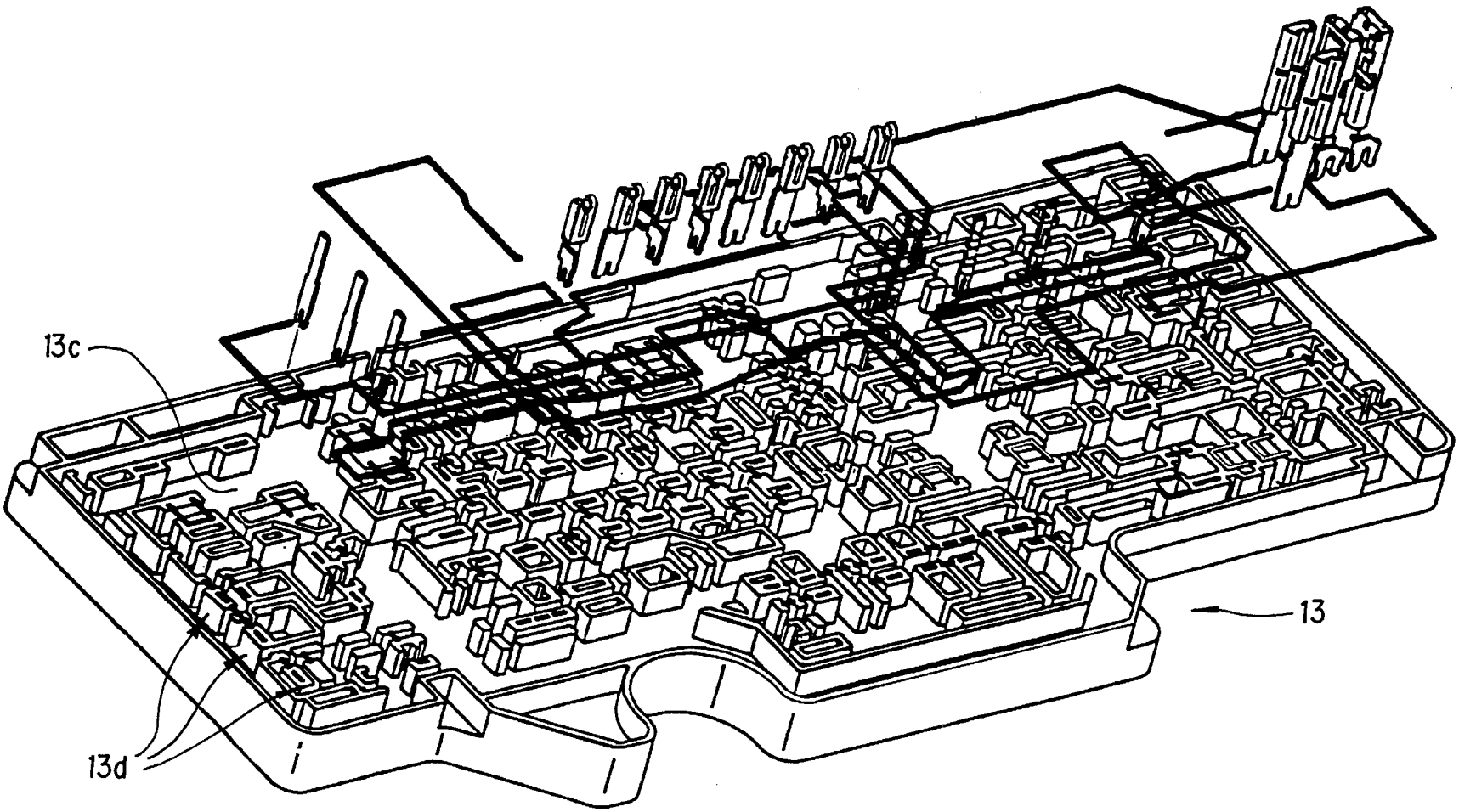
FIG. 4 is a perspective view showing the lower surface of an electrical insulating plate.

A plurality of guide cylinders 13*d* (one of which is shown in FIG. 2 and others are shown in FIG. 4) project downward from the plate 13 and are molded integrally with the plate 13. A short terminal 17 is shown inserted upwardly into the recess of the guide cylinder 13*d* to connect by a pressure grip with the required one of the wires 15 in the space 20. A male tab 17*a* of the terminal 17 projects downwardly out from the lower case 10 through a terminal hole 10*a* thereof (see FIG. 1).

A plurality of guide cylinders 13*f* (one of which is shown in FIG. 2 and others are shown in FIG. 1) project both upward and downward from the plate 13, and are molded integrally with the plate. A long terminal 18 is inserted downward into the recess of the guide cylinder 13*f* connect by a pressure grip with the required one of the wires 15 in the space 20. A male tab 18*a* of the terminal 18 projects upwardly out from the upper case 11 through a terminal hole thereof (not shown).

Bus bars 19A, 19B, and 19C and insulation plates 22A and 22B are accommodated alternately in a stack in the bus bar accommodating space 21 located between the plate 13 and the upper case 11. The stack is carried by the plate 13. More specifically, the insulation plate 22A is interposed between the bus bars 19A and 19B, and the insulation plate 22B is interposed between the bus bars 19B and 19C. The lowermost bus bar 19A lies on supports 13*g* (see FIG. 1) projecting upwardly from the plate 13 and also molded integrally with the plate 13.

As shown in FIG. 1, the bus bars 19A, 19B, and 19C have main planar portions 29*a*, 29*b*, 29*c* parallel to the plate 13 and are bent upward or downward with respect to main planar portions thereof to form male tabs 39*a*, 39*b*, 39*c*. The male tabs 39*a*, 39*b*, 39*c* project upward through the upper case 11 and downward through the lower case 10 through terminal holes to enable them to make electrical connection with terminals (not shown) of external circuits.

In use in a vehicle, the electrical connection box is fixedly mounted at a desired location in the vehicle, e.g., in the engine compartment.

When the electrical connection box is assembled, the upper and lower cases 10,11 rest on the outermost ends of the guide cylinders 13*d*, 13*f*. The bus bar stack and the wires 15 thus do not project above or below the outermost ends of the cylinders 13*d*, 13*f* (apart from projecting tabs).

Circuits of safety devices of the vehicle such as a power source input circuit, an ignition switch circuit, an air bag circuit, and a door locking circuit partly comprise the bus bars 19A, 19B, and 19C, which are directly connected to external circuit portions of these circuits by the tabs 39*a*, 39*b*, 39*c*. Referring to FIG. 1, a part of the power source input circuit is denoted by (a); a part of the ignition switch circuit is denoted by (b); a part of the air bag circuit is denoted by (c); and a part of the door locking circuit is denoted by (d).

FIG. 1 indicates that circuit components, e.g. fuse boxes 14, are mounted on the exterior of the upper and lower cases 10,11 in conventional manner.

Signal circuits and lamp circuits are partly composed of the wires IS and the terminals 17 and 18. The ignition switch circuit, the air bag circuit, the door locking circuit, and other circuits have hitherto been constituted of wires and terminals, whereas in the electrical connection box according to the present invention, these circuits are composed of the bus bars 19A, 19B, and 19C, as described above. Thus, the electrical connection box of the present invention has a smaller number of circuits constituted of wires and terminals than the conventional electrical connection box. Nevertheless, the space 20 can accommodate more wires than the conventional electrical connection box, because there are fewer terminals. The space 20 easily allows variation of the layout of the wires 15 in it. The electrical connection box of the present invention having the above-described internal construction is partitioned into the electric wire accommodating space 20 and the bus bar accommodating space 21. Thus, there is little or no dead space in the bus bar accommodating space 21 and hence the bus bars 19A, 19B, and 19C can be efficiently accommodated in the bus bar accommodating space 21. That is to say, the bus bars 19A, 19B, and 19C are accommodated in the bus bar accommodating space 21 at a level lower than the outermost ends of the guide cylinders 13*f*. Thus, the electrical connection box of the present invention can have a small thickness and yet have a greater number of circuits than a conventional one.

Further, the circuits of the safety devices, namely, the ignition switch circuit, the air bag circuit, and the door locking circuit in the electrical connection box of the present invention, are formed partly of the bus bars 19A, 19B, and 19C so that each circuit has only one contact portion, at the male tab of the bus bars 19A, 19B, and 19C, and a terminal of the external circuit part. Such a configuration has a reliable electric contact performance, which can increase vehicle safety.

Furthermore, the long terminals 18 and the short terminal 17 are connected with the electric wires 15 in the electric wire accommodating space 20 by insertion respectively from the upper side and the lower side. Thus only one terminal type is inserted into the body of the electrical connection box upward and downward, respectively. This simplifies assembly and minimizes the number of parts required.

As described above, the interior of the electrical connection box is partitioned vertically into the electrical wire accommodating space and the bus bar accommodating space by the electric wire insulation plate positioned therebetween. Thus, the thickness and area of the electrical connection box can be smaller than those of the conventional electrical connection boxes, because several circuits are formed of bus bars. That is to say, electrical wires can be densely installed inside the electrical connection box and yet the thickness and area of the electrical connection box may be smaller than in the known electrical connection boxes.

Although the present invention has been fully described and illustrated by the preferred embodiment with reference to the accompanying drawings, it is to be noted that various changes and modifications are possible. Such changes and modifications are to be understood as included within the scope of the present invention.

What is claimed is:

1. An electrical connection box comprising:

a casing providing an interior space;

an electrically insulating plate located in said interior space and dividing said interior space into a first space region and a second space region;

at least two bus bars and at least one insulation layer alternately arranged in a stack in said first space region with each of said bus bars in said stack being separated from an adjacent said bus bar by an insulation layer of said at least one insulation layer, said stack being supported by said electrically insulating plate, said plurality of bus bars constituting a plurality of first internal electrical circuits of said electrical connection box;

a plurality of electrical wires accommodated in said second space region and supported by said electrically insulating plate;

a plurality of first electrical terminal members connected to ones of said plurality of electrical wires by pressure grip connections, said first terminal members having corresponding tab portions projecting out of said second space region and through said casing on one side of said electrically insulating plate for connection to terminals of external circuits outside said casing; and a plurality of second electrical terminal members connected to ones of said plurality of electrical wires by pressure grip connections, said second terminal members having corresponding tab portions projecting out of said second space region and through said casing on an opposite side of said electrically insulating plate for connection to terminals of external circuits outside said casing, wherein said electrical wires and said plurality of first and second terminal members constitute a plurality of second internal electrical circuits of said electrical connection box, and said first and second terminal members are assembled on said electrically insulating plate by insertion in directions substantially transverse to said electrically insulating plate.

2. An electrical connection box according to claim 1, wherein said electrically insulating plate has a substantially planar sheet portion dividing said first space region from said second space region, and said insertion directions of said first and second electrical terminal members are perpendicular to the plane of said sheet portion.

3. An electrical connection box according to claim 2, wherein said electrically insulating plate has a plurality of guide members on both sides of said sheet portion, each said guide member extending away from said sheet portion and providing a recess for receiving a respective one of said electrical terminal members.

4. An electrical connection box according to claim 3, wherein said bus bars and said insulation layers in said stack within said first space region have planar portions lying substantially parallel to the plane of said sheet portion and lying not further from said sheet portion than outer ends of said guide members on the corresponding side of said insulating plate.

5. An electrical connection box according to claim 4, wherein each of said bus bars has, formed in one-piece with said planar portion thereof, at least one tab portion extending perpendicularly to said planar portion and extending outward from said first space region and through said casing, so as to be available for connection to a terminal of an external circuit outside said casing.

6. An electrical connection box according to claim 3, wherein said electrical wires in said second space region lie not further from said sheet portion than outer ends of said guide members on the corresponding side of said insulating plate.

7. An electrical connection box according to claim 1, wherein said electrically insulating plate has a plurality of projections in said second space region separated by gaps in which said electrical wires lie, so that said projections retaining said electrical wires in position.

8. A vehicle having a plurality of external electrical circuits, comprising:

a casing provided within said vehicle, said casing defining an interior space;

an electrically insulating plate located in said interior space and dividing said interior space into a first space region and a second space region;

at least two bus bars and at least one insulation layer alternately arranged in a stack in said first space region with each of said bus bars in said stack being separated from an adjacent said bus bar by an insulation layer of said at least one insulation layer, said stack being supported by said electrically insulating plate, said plurality of bus bars constituting a plurality of first internal electrical circuits of said electrical connection box;

a plurality of electrical wires accommodated in said second space region and supported by said electrically insulating plate;

a plurality of first terminal members connected to ones of said plurality of electrical wires by pressure grip connections, said first terminal members having corresponding tab portions projecting out of said second space region and through said casing on one side of said electrically insulating plate for connection to terminals of external circuits outside said casing; and a plurality of second terminal members connected to ones of said plurality of electrical wires by pressure grip connections, said second terminal members having corresponding tab portions projecting out of said second space region and through said casing on an opposite side of said electrically insulating plate for connection to terminals of external circuits outside said casing, wherein said electrical wires and said plurality of first and second terminal members constitute a plurality of second internal electrical circuits of said electrical connection box, said first and second electrical terminal members are assembled on said electrically insulating plate by insertion in directions substantially transverse to said electrically insulating plate, and at least one of said external electrical circuits is connected to said internal electrical circuits of said electrical connection box by connection to at least one tab portion of at least one of said first and second electrical terminal members.

9. A vehicle according to claim 8, wherein said external electrical circuits include at least one of a power source input circuit, an ignition switch circuit, an air bag circuit, and a door locking circuit connected directly to one of said bus bars.

* * * * *